US011584599B2

(12) United States Patent
Shibata et al.

(10) Patent No.: US 11,584,599 B2
(45) Date of Patent: Feb. 21, 2023

(54) TRANSPORTATION APPARATUS

(71) Applicant: RISO KAGAKU CORPORATION, Tokyo (JP)

(72) Inventors: Ryuichi Shibata, Tsukuba (JP); Miki Okawara, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 255 days.

(21) Appl. No.: 17/098,801

(22) Filed: Nov. 16, 2020

(65) Prior Publication Data

US 2021/0155428 A1 May 27, 2021

(30) Foreign Application Priority Data

Nov. 27, 2019 (JP) ..... JP2019-214510

(51) Int. Cl.

| | |
|---|---|
| ***B65H 29/58*** | (2006.01) |
| ***B65H 5/06*** | (2006.01) |
| ***B65H 5/34*** | (2006.01) |
| ***B65H 85/00*** | (2006.01) |
| ***B41J 11/00*** | (2006.01) |

(52) U.S. Cl.

CPC ..... *B65H 5/062* (2013.01); *B41J 11/0045* (2013.01); *B65H 85/00* (2013.01)

(58) Field of Classification Search

CPC . B65H 5/062; B65H 5/06; B65H 5/34; B65H 2513/20; B65H 2513/10; B65H 2513/50; B65H 2513/51; B65H 2513/512; B65H 29/58; B65H 85/00; B65H 2301/33; B65H 2301/3331; B65H 2301/33312; B41J 11/0045

See application file for complete search history.

(56) References Cited

U.S. PATENT DOCUMENTS

| | | | | |
|---|---|---|---|---|
| 8,038,144 | B2 | 10/2011 | Hara | |
| 10,131,164 | B2 * | 11/2018 | Hara | B41J 11/42 |
| 11,319,178 | B2 * | 5/2022 | Inoue | B65H 7/08 |
| 2018/0162146 | A1 * | 6/2018 | Kojima | B41J 11/007 |

FOREIGN PATENT DOCUMENTS

| | | |
|---|---|---|
| EP | 1754675 | 2/2007 |
| JP | 2004-343892 A | 12/2004 |

OTHER PUBLICATIONS

Apr. 27, 2022 Chinese Office Action in corresponding Chinese Application No. 202011295851.5 and English translation thereof.

Apr. 28, 2021 extended European Search Report in corresponding European Application No. 20208736.7.

* cited by examiner

*Primary Examiner* — Luis A Gonzalez

(74) *Attorney, Agent, or Firm* — Greenblum & Bernstein, P.L.C.

(57) ABSTRACT

A transportation apparatus includes a plurality of transportation members that are arranged in a transportation direction for a medium and transport the medium, a plurality of actuators that drive the plurality of transportation members, and a processor that controls the plurality of actuators in such a manner as to increase transportation velocities of the plurality of actuators in order from actuators for driving transportation members on a downstream side in the transportation direction to actuators for driving transportation members on an upstream side in the transportation direction.

5 Claims, 4 Drawing Sheets

TRANSPORTATION APPARATUS

CROSS-REFERENCE TO RELATED APPLICATION

This application is based upon and claims the benefit of priority of the prior Japanese Patent Application No. 2019-214510, filed on Nov. 27, 2019, the entire contents of which are incorporated herein by reference.

FIELD

The aspects described herein are related to a transportation apparatus that transports a medium.

BACKGROUND

Transportation apparatuses that transport media have conventionally been such that when increasing the transportation velocities of a plurality of drive units for driving a plurality of transportation members such as transportation roller pairs, a large load is applied to the power supply due to an increase in the total of the current values of the drive units. Accordingly, motor driving control methods have been proposed wherein the transportation velocities of motors are increased in order from those for driving the transportation members on the upstream side in the direction of transportation of media to those for driving the transportation members on the downstream side in this direction (e.g., Japanese Laid-open Patent Publication No. 2004-343892).

SUMMARY

In an aspect, a transportation apparatus includes a plurality of transportation members that are arranged in a transportation direction for a medium and transport the medium, a plurality of drive units that drive the plurality of transportation members, and a control unit that controls the plurality of drive units in such a manner as to increase transportation velocities of the plurality of drive units in order from drive units for driving transportation members on a downstream side in the transportation direction to drive units for driving transportation members on an upstream side in the transportation direction.

The object and advantages of the present invention will be realized by the elements set forth in the claims and combinations thereof.

DESCRIPTION OF EMBODIMENTS

Figure 1:
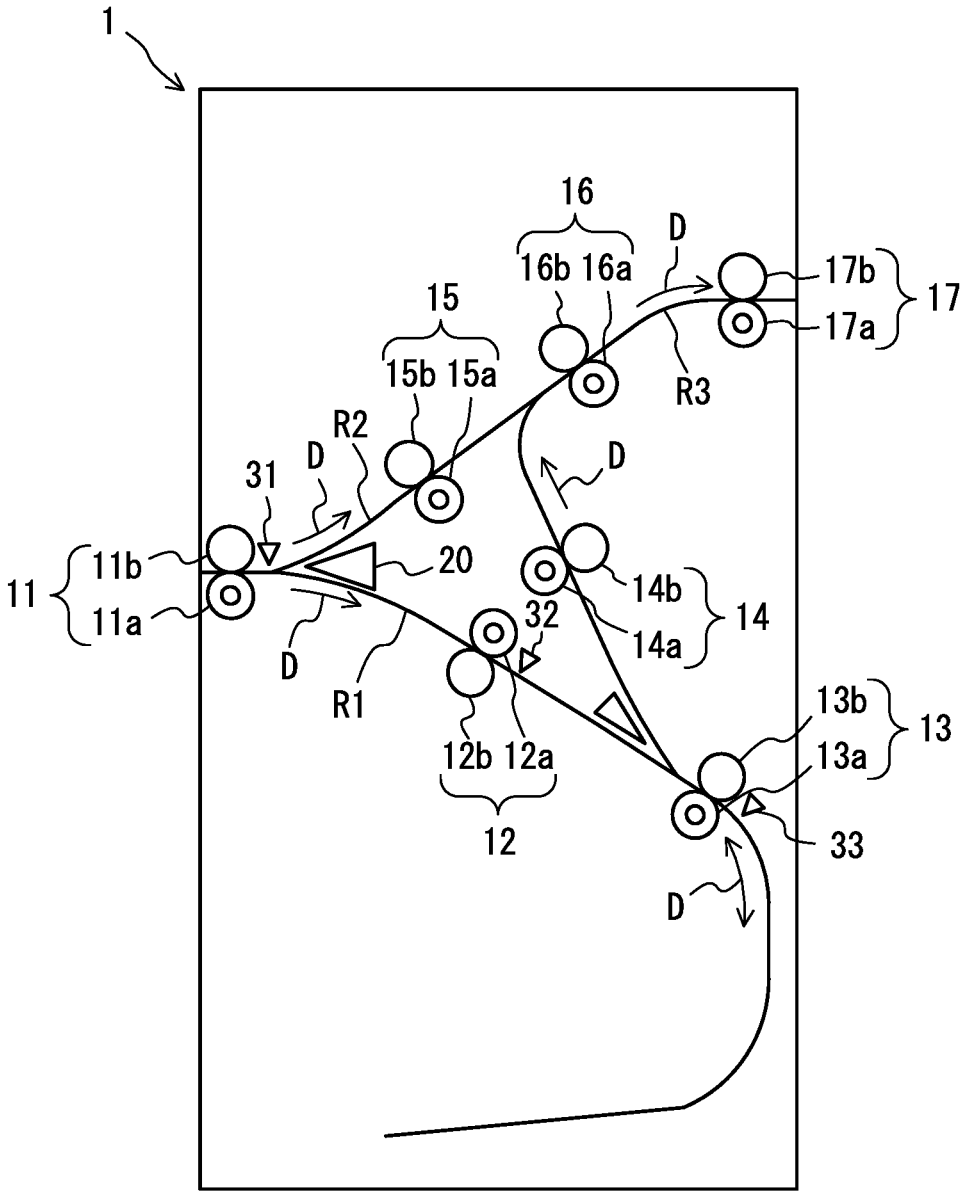
FIG. 1 illustrates the internal structure of a transportation apparatus in accordance with an embodiment.

When the transportation velocities of a plurality of drive units are increased in order from those for driving transportation members on the upstream side in the transportation direction to those for driving transportation members on the downstream side in the transportation direction, the transportation velocities of the transportation members on the upstream side become higher than those on the downstream side, thereby loosening a medium. Thus, the medium could be inserted into a transportation member with both sides sandwiching a loose portion and thus folded in a Z shape, a pooling sound could be generated when eliminating the looseness, or the medium could be stained due to coming into contact with a transportation guide. Accordingly, a transportation failure could occur when the transportation velocities of a plurality of drive units are increased in order from those for driving transportation members on the upstream side in the transportation direction to those for driving transportation members on the downstream side in the transportation direction.

The following describes a transportation apparatus in accordance with embodiments of the present invention by referring to the drawings.

FIG. 1 illustrates the internal structure of a transportation apparatus 1 in accordance with an embodiment.

Figure 2:
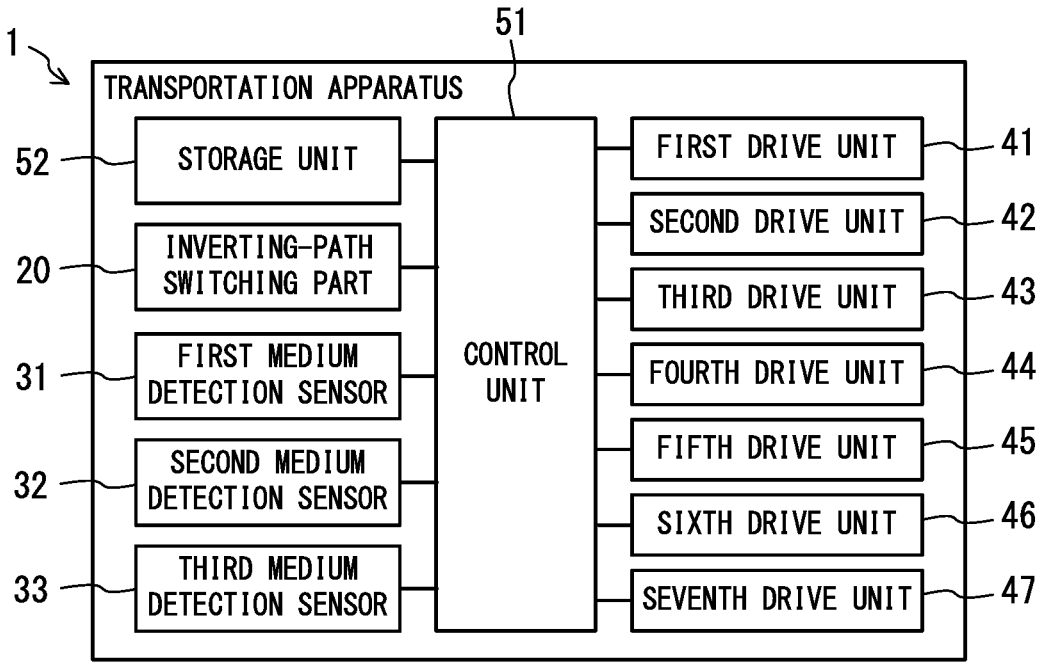
FIG. 2 illustrates the control configuration of a transportation apparatus in accordance with an embodiment.

FIG. 2 illustrates the control configuration of a transportation apparatus 1 in accordance with an embodiment.

As depicted in FIG. 1, the transportation apparatus 1 includes first to seventh transportation roller pairs 11, 12, 13, 14, 15, 16, and 17, an inverting-path switching part 20, and first to third medium detection sensors 31, 32, and 33. As depicted in FIG. 2, the transportation apparatus 1 also includes first to seventh drive units 41, 42, 43, 44, 45, 46, and 47, a control unit 51, and a storage unit 52.

The transportation apparatus 1 may transport media and may be, for example, a relay transportation apparatus positioned between a printing apparatus for printing on media and a medium ejection apparatus for ejecting media or between two printing apparatuses. Alternatively, the transportation apparatus 1 may be incorporated integrally into an apparatus such as a printing apparatus.

The first to seventh transportation roller pairs 11 to 17 include driving rollers 11*a*, 12*a*, 13*a*, 14*a*, 15*a*, 16*a*, and 17*a* and driven rollers 11*b*, 12*b*, 13*b*, 14*b*, 15*b*, 16*b*, and 17*b*. The driving rollers 11*a*-17*a* are driven by the first to seventh drive units 41, 42, 43, 44, 45, 46, and 47, which will be described hereinafter.

The first to seventh transportation roller pairs 11 to 17 are arranged in a transportation direction D for media and transport the media in a nipping manner. The first transportation roller pair 11 is located at a medium insertion opening of the transportation apparatus 1. The second to fourth transportation roller pairs 12 to 14 are disposed on an inverting path R1 that inverts the front and back sides of a medium. The third transportation roller pair 13 functions as a switchback roller pair for inverting the front and back sides of a medium and transports the medium in a positive or negative direction. The fifth transportation roller pair 15 is disposed on a non-inverting path R2 that passes the inverting path R1. The sixth and seventh transportation roller pairs 16 and 17 are positioned on a joining path R3 where the inverting path R1 and the non-inverting path R2 join.

The inverting path R1 is an example of a first transportation path. The non-inverting path R2 is an example of a second transportation path having a greater path length than the first transportation path (inverting path R1) and joining the first transportation path. The first and second transportation paths are not limited to the inverting path R1 and the non-inverting path R2.

The transportation roller pairs 11-17 are examples of transportation members that are arranged in the transportation direction D for media and transport the media in a nipping manner. The transportation members may be transportation belts. The transportation apparatus 1 does not necessarily include the inverting path R1 and the non-inverting path R2, i.e., branched transportation paths, but may include a single transportation path alone.

The inverting-path switching part 20 is a movable guide for switching the transportation path between the inverting path R1 and the non-inverting path R2. The inverting-path switching part 20 is an example of a transportation path switching part for switching the transportation path between the first transportation path (inverting path R1) and the second transportation path (non-inverting path R2).

For example, the first to third medium detection sensors 31 to 33 may sense the presence/absence of a medium in accordance with whether a light reception unit receives sensing light emitted by a light emission unit. The first medium detection sensor 31 is disposed in the vicinity of the first transportation roller pair 11 at a position downstream from the first transportation roller pair 11 in the transportation direction D. The second medium detection sensor 32 is disposed in the vicinity of the second transportation roller pair 12 at a position downstream from the second transportation roller pair 12 in the transportation direction D. The third medium detection sensor 33 is disposed in the vicinity of the third transportation roller pair 13 at a position downstream from the third transportation roller pair 13 in the transportation direction D (before reverse transportation).

The first to seventh drive units 41 to 47 depicted in FIG. 2 drive the first to seventh transportation roller pairs 11 to 17. For example, the first to seventh drive units 41 to 47 may be actuators such as motors.

The control unit 51 includes a processor (e.g., central processing unit (CPU)) for functioning as an arithmetic processing apparatus for controlling operations of components of the transportation apparatus 1. When the transportation apparatus 1 is incorporated integrally into another apparatus such as a printing apparatus, a control unit for the other apparatus may also serve as the control unit 51.

As will be described hereinafter in detail, the control unit 51 controls the first to third drive units 41 to 43 in such a manner as to increase the transportation velocities of the drive units in order of the third drive unit 43 for driving the third transportation roller pair 13 located on the downstream side in the transportation direction D, then the second drive unit 42 for driving the second transportation roller pair 12 located on the upstream side, and finally the first drive unit 41 for driving the first transportation roller pair 11 located upstream from the second transportation roller pair 12. For example, the transportation velocities of the fourth to seventh drive units 44 to 47 may be constant.

For example, the storage unit 52 may be a read only memory (ROM) that is a read-only semiconductor memory having a predetermined control program recorded therein in advance, or a random access memory (RAM) that is a randomly writable/readable semiconductor memory used as a working storage region on an as-needed basis when a processor executes various control programs.

Figure 3:
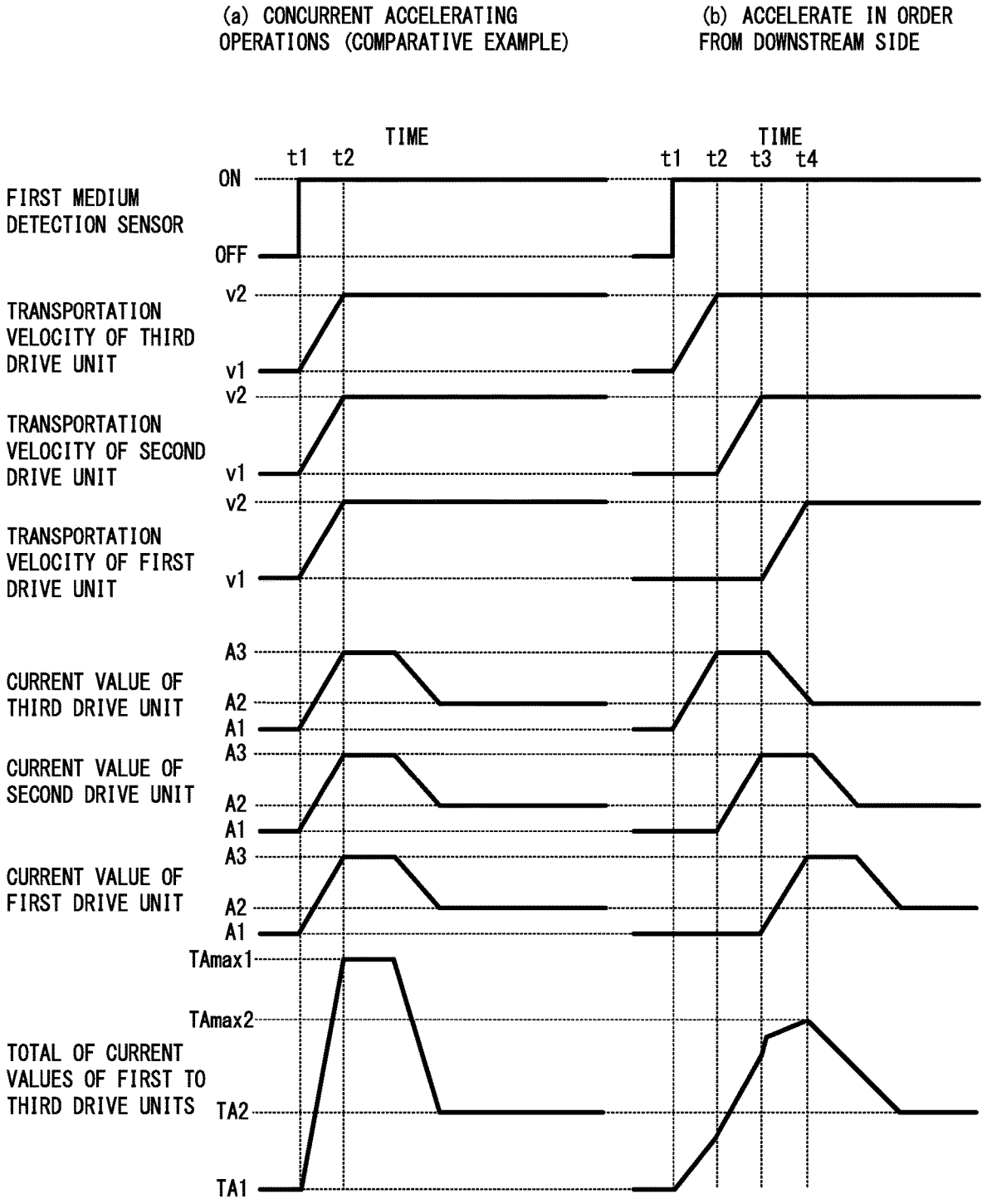
FIG. 3 is an explanatory diagram for illustrating the transportation velocities and the current values of first to third drive units in an embodiment.

The following describes the transportation velocities and the current values of the first to third drive units 41 to 43 by referring to FIG. 3.

FIG. 3(*a*) presents an example of a situation (comparative example) in which the transportation velocities of the first to third drive units 41 to 43 are concurrently increased. FIG. 3(*b*) presents an example of a situation in which the transportation velocities of the third drive unit 43, the second drive unit 42, and the first drive unit 41 are increased in this order.

In the comparative example, when the first medium detection sensor 31 has sensed a medium (time t1) , the control unit 51 controls the first to third drive units 41 to 43 so as to increase the transportation velocities from a velocity v1 to a velocity v2, as depicted in FIG. 3(*a*). Note that the velocity v1 is a predetermined transportation velocity that may be zero (at which driving is stopped).

The control unit 51 may determine the velocity v2, an acceleration start time, an acceleration rate, and the like so as to control the first to fifth drive units 41 to 45 in a manner such that an equal length of time is required before a medium arrives at the joining path R3 between a case where the medium is transported to the inverting path R1 depicted in FIG. 1 and a case where the medium is transported to the non-inverting path R2.

The current values of the first to third drive units to 43 increase from the current value A1 when the transportation velocities start to increase. Then, the current values of the first to third drive units 41 to 43 increase to a current value A3 at which the transportation velocities reach the velocity v2 (time t2) and, after the elapse of a certain time period since time t2, become stable at a current value A2 which is higher than the current value A1 and lower than the current value A3.

The total of the current values of the first to third drive units 41 to 43 increases from a current value TA1 (current value A1 multiplied by three) at which the transportation velocities start to increase (time t1) to a maximum current value TAmax1 (current value A3 multiplied by three) at which the transportation velocities reach the velocity t2 (time t2) and then become stable at a current value TA2 (current value A2 multiplied by three).

In embodiments, by contrast, when the first medium detection sensor 31 has sensed a medium (time t1) , the control unit 51 first controls the third drive unit 43 so as to increase the transportation velocity from the velocity v1 to the velocity v2, as depicted in FIG. 3(*b*). The time at which the transportation velocity of the third drive unit 43 starts to increase is not limited to the time t1 at which the first medium detection sensor 31 senses a medium but may be set as appropriate.

The current value of the third drive unit 43 increases from the current value A1 when the transportation velocity starts to increase. Then, the current value of the third drive unit 43 increases to a current value A3 at which the transportation velocity reaches the velocity v2 (time t2) and, after the elapse of a certain time period since time t2, becomes stable at a current value A2 which is higher than the current value A1 and lower than the current value A3.

At time t2, e.g., a time several milliseconds after time t1, the control unit 51 controls the second drive unit 42 so as to increase the transportation velocity from the velocity v1 to the velocity v2. On the basis of at least either the length of the medium in the transportation direction D or the spacings between the first to third transportation roller pairs 11 to 13, the control unit 51 may determine a time to start to increase the transportation velocity of the second drive unit 42 (time t2) and a time to start to increase the transportation velocity of the third drive unit 43 (time t3), which will be described hereinafter. As an example, the longer the medium in the transportation direction D or the longer the spacings between the first to third transportation roller pairs 11 to 13, the later times the control unit 51 may set as times t2 and t3.

The current value of the second drive unit 42 increases from the current value A1 when the transportation velocity starts to increase. Then, the current value of the second drive unit 42 increases to a current value A3 at which the transportation velocity reaches the velocity v2 (time t3) and, after the elapse of a certain time period since time t3, becomes stable at a current value A2 which is higher than the current value A1 and lower than the current value A3.

At time t3, e.g., a time several milliseconds after time t2, the control unit 51 controls the first drive unit 41 so as to increase the transportation velocity from the velocity v1 to the velocity v2.

The current value of the first drive unit 41 increases from the current value A1 when the transportation velocity starts to increase. Then, the current value of the first drive unit 41 increases to a current value A3 at which the transportation velocity reaches the velocity v2 (time t4) and, after the elapse of a certain time period since time t4, becomes stable at the current value A2 which is higher than the current value A1 and lower than the current value A3.

As described above, at, for example, the time t1 at which the first medium detection sensor 31 senses a medium, the control unit 51 controls the first to third drive units 41 to 43 in such a manner as to increase the transportation velocities of the drive units in order of the third drive unit 43 for driving the third transportation roller pair 13 located on the downstream side in the transportation direction D, then the second drive unit 42 for driving the second transportation roller pair 12 located on the upstream side, and finally the first drive unit 41 for driving the first transportation roller pair 11 located upstream from the second transportation roller pair 12. In this way, the transportation velocities of the first to third drive units 41 to 43 increase from the velocity v1 to the velocity v2.

Accordingly, the first to third drive units 41 to 43 each take a different length of time to reach the current value A3, i.e., the maximum current value. Thus, although the total of the current values of the first to third drive units 41 to 43 is the same as that in the comparative example in terms of the current value TA1 (current value A1 multiplied by three) at which the transportation velocity of the third drive unit 43 starts to increase (time t1) and the current value TA2 (current value A2 multiplied by three), the maximum current value TAmax2 (e.g., about 7.0 A) is lower than the maximum current value TAmax1 (e.g., 9.0 A) in the comparative example. Meanwhile, the total of the current values of the first to third drive units 41 to 43 is maintained at the maximum current value TAmax2 for a period shorter than the period of the maximum current value TAmax1 (current value A3 multiplied by three) in the comparative example.

The transportation velocities of the first to third drive units 41 to 43 are different during the period from the time when the transportation velocities of the first to third drive units 41 to 43 start to increase to the time when all of the transportation velocities of the first to third drive units 41 to 43 are the velocity v2. However, while the transportation velocities of the first to third drive units 41 to 43 are different, even when the leading edge of a medium in the transportation direction D reaches the second transportation roller pair 12 and the third transportation roller pair 13 and is thus nipped by the plurality of transportation roller pairs, the medium will not be loosened, because the transportation velocities of the second transportation roller pair 12 and the third transportation roller pair 13 which are on the downstream side are higher than that of the first transportation roller pair 11 which is on the upstream side.

After the rear edge of the medium in the transportation direction D passes the first medium detection sensor 31, the transportation velocity of the first drive unit 41 may be returned to the pre-acceleration velocity v1, and after the rear edge of the medium in the transportation direction D passes the second medium detection sensor 32, the transportation velocity of the second drive unit 42 may be returned to the pre-acceleration velocity v1. Meanwhile, since the third transportation roller pair 13 functions as a switchback roller pair, the velocity v2 of the third drive unit 43 may be increased to, for example, a velocity in an opposite direction when rotating the third transportation roller pair 13 backward.

Figure 4:
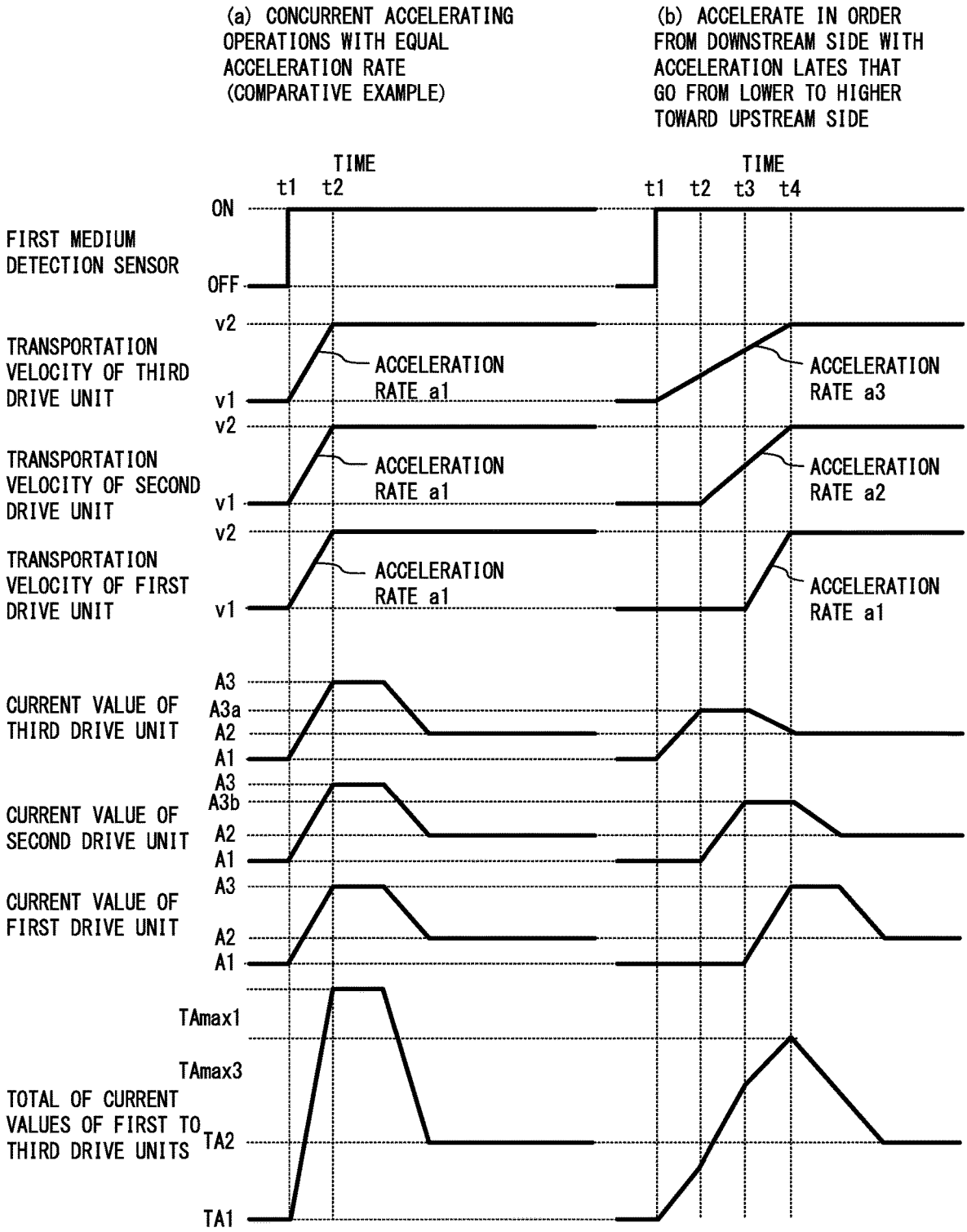
FIG. 4 is an explanatory diagram for illustrating the transportation velocities and the current values of first to third drive units in a variation of an embodiment.

FIG. 4(*a*) presents an example of a situation (comparative example) in which the transportation velocities of the first to third drive units 41 to 43 are concurrently increased with a same acceleration rate a1. FIG. 4(*b*) presents an example of a situation (variation) in which the transportation velocities of the third drive unit 43, the second drive unit 42, and the first drive unit 41 are increased in this order, and the acceleration rate a3 of the third drive unit 43, the acceleration rate a2 of the second drive unit 42, and the acceleration rate a1 of the first drive unit 41 go from lower to higher in this order.

The comparative example depicted in FIG. 4(*a*) is the same as that depicted in FIG. 3(*a*), and descriptions thereof are omitted herein.

In this variation, when the first medium detection sensor 31 has sensed a medium (time t1), the control unit 51 first controls the third drive unit 43 so as to increase the transportation velocity from a velocity v1 to a velocity v2, as depicted in FIG. 4(*b*). In this case, the acceleration rate is acceleration rate a3.

The current value of the third drive unit 43 increases from the current value A1 when the transportation velocity starts to increase. Then, the current value of the third drive unit 43 increases to a maximum current value A3*a* at, for example, a time t2 preceding a time at which the transportation velocity reaches the velocity v2 (time t4). This maximum current value A3*a* is lower than the maximum current value A3*a* in the comparative example because the acceleration rate a3 of the transportation velocity of the third drive unit 43 is lower than the acceleration rate a1 in the comparative example. Subsequently, the current value of the third drive unit 43 becomes stable at a current value A2 which is higher than the current value A1 and lower than the current value A3*a*.

At time t2, e.g., a time several milliseconds after time t1, the control unit 51 controls the second drive unit 42 so as to increase the transportation velocity from the velocity v1 to the velocity v2. In this case, the acceleration rate is acceleration rate a2.

The current value of the second drive unit 42 increases from the current value A1 when the transportation velocity starts to increase. Then, the current value of the second drive unit 42 increases to a maximum current value A3*b* at, for example, a time t3 preceding a time at which the transportation velocity reaches the velocity v2 (time t4). This maximum current value A3*b* is lower than the maximum current value A3*a* in the comparative example because the acceleration rate a2 of the transportation velocity of the second drive unit 42 is lower than the acceleration rate a1 in the comparative example, but is higher than the maximum current value A3*a* of the third drive unit 43 because the acceleration a2 is higher than the acceleration rate a3 of the third drive unit 43. Subsequently, the current value of the second drive unit 42 becomes stable at the current value A2 which is higher than the current value A1 and lower than the current value A3*b*.

At time t3, e.g., a time several milliseconds after time t2, the control unit 51 controls the first drive unit 41 so as to increase the transportation velocity from the velocity v1 to the velocity v2. In this case, the acceleration rate is acceleration rate a1 as in the comparative example.

The current value of the first drive unit 41 increases from the current value A1 when the transportation velocity starts to increase. Then, the current value of the first drive unit 41 increases to the maximum current value A3 at a time at which the transportation velocity reaches the velocity v2 (time t4). This maximum current value A3 is higher than the current values A3*a* and A3*b* and equal to the maximum current value A3 in the comparative example because the acceleration rate a1 is, as described above, higher than the acceleration rate a3 of the third drive unit 43 and the acceleration rate a2 of the second drive unit 42. Subsequently, the current value of the first drive unit 41 becomes stable at the current value A2 which is higher than the current value A1 and lower than the current value A3.

In this variation, as described above, the control unit 51 also controls the first to third drive units 41 to 43 in such a manner as to increase the transportation velocities of the drive units in order of the third drive unit 43 for driving the third transportation roller pair 13 located on the downstream side in the transportation direction D, then the second drive unit 42 for driving the second transportation roller pair 12 located on the upstream side, and finally the first drive unit 41 for driving the first transportation roller pair 11 located upstream from the second transportation roller pair 12. In this variation, the control unit 51 also controls the first to third drive units 41 to 43 such that the acceleration rate a3 of the transportation velocity of the third drive unit 43, the acceleration rate a2 of the transportation velocity of the second drive unit 42, and the acceleration rate a1 of the transportation velocity of the first drive unit 41 go from lower to higher in this order so as to finish the accelerating operations at the same time.

Accordingly, the first to third drive units 41 to 43 take different lengths of time to reach the current values A3, A3*a*, and A3*b*, i.e., the maximum current values. The current values A3*a* and A3*b* of the second drive unit 42 and the third drive unit 43 are lower than the maximum current values of the second drive unit 42 and the third drive unit 43 in the comparative example and the current value A3 of the first drive unit 41. Thus, although the total of the current values of the first to third drive units 41 to 43 is the same as that in the comparative example in terms of the current value TA1 (current value A1 multiplied by three) at which the transportation velocity of the third drive unit 43 starts to increase (time t1) and the current value TA2 after stabilization (current value A2 multiplied by three), the maximum current value TAmax3 (e.g., about 7.0 A) is lower than the maximum current value TAmax1 in the comparative example. Meanwhile, the total of the current values of the first to third drive units 41 to 43 is maintained at the maximum current value TAmax3 for a period shorter than the period of the maximum current value TAmax1 (current value A3 multiplied by three) in the comparative example.

In the embodiments described above, the transportation apparatus 1 includes: the first to third transportation roller pairs 11 to 13 that are arranged in the transportation direction D for a medium and transport the medium, i.e., examples of the plurality of transportation members; the first to third drive units 41 to 43 that drive the first to third transportation roller pairs 11 to 13, i.e., examples of the plurality of drive units; and the control unit 51 that controls the first to third drive units 41 to 43 in such a manner as to increase the transportation velocities of the drive units in order from the third drive unit 43 for driving the transportation roller pair 13 located on the downstream side in the transportation direction D to the second drive unit 42 and the first drive unit 41 for driving the second transportation roller pair 12 and the first transportation roller pair 11 located on the upstream side.

Accordingly, the maximum value of the total of the current values of the first to third drive units 41 to 43 can be decreased or the period of the maximum value can be shortened in comparison to when the transportation velocities of the first to third drive units 41 to 43 concurrently start to be increased (the comparative examples depicted in FIGS. 3(*a*) and 4(*a*)). In addition, in comparison to when the transportation velocity of the first drive unit 41 for driving the first transportation roller pair 11 located on the upstream side in the transportation direction D and the transportation velocities of the second drive unit 42 and the third drive unit 43 for driving the second transportation roller pair 12 and the third transportation roller pair 13 located on the downstream side are increased in this order, the medium will not be loosened since the transportation velocities of the drive units for driving the transportation roller pairs on the downstream side do not become lower than those of the drive units for driving the transportation roller pairs on the upstream side. Thus, the medium can be prevented from being inserted into the second transportation roller pair 12 or the third transportation roller pair 13 with both sides sandwiching a loose portion and thus folded in a Z shape, a pooling sound can be prevented from being generated when eliminating the looseness, or the medium can be prevented from being stained due to coming into contact with a transportation guide. In embodiments, accordingly, the load on the power supply when increasing the transportation velocity can be reduced, and the occurrence of failure in transportation of media can be decreased.

In embodiments, the transportation apparatus 1 further includes the inverting-path switching part 20, i.e., an example of the transportation path switching part, which switches the transportation path between the inverting path R1 for inverting the front and back sides of a medium, i.e., an example of the first transportation path, and the non-inverting path R2 having a less path length than the inverting path R1 and joining the inverting path R1, i.e., an example of the second transportation path. The first to third transportation roller pairs 11 to 13 transport media for which the transportation path has been switched to the inverting path R1 by the inverting-path switching part 20, and the control unit 51 controls the first to fifth drive units 41 to 45 in a manner such that an equal length of time is required before a medium arrives at the joining path R3 between a case where the medium is transported to the inverting path R1 and a case where the medium is transported to the non-inverting path R2. Accordingly, even when some media are transported to the first transportation path, e.g., transported to the inverting path P1 and thus the front and back sides thereof are inverted, while other media are transported to the second transportation path, e.g., transported to the non-inverting path P2 and thus the front and back sides thereof are not inverted, these media can be transported on the joining path R3 without stopping the transportation thereof. Hence, the efficiency of transportation of media can be enhanced.

In embodiments, on the basis of at least either the length of a medium in the transportation direction D or the spacings between the first to third transportation roller pairs 11 to 13, the control unit 51 determines times to start to increase the transportation velocities of the first to third drive units 41 to 43 (times t1, t2, and t3). Thus, the intervals between the times to start to increase the transportation velocities of the first to third drive units 41 to 43 can be extended in accordance with the configuration of the transportation apparatus 1 or the conditions for transportation of media. Accordingly, the maximum value of the total of the current values of the first to third drive units 41 to 43 can be further decreased or the period of the maximum value can be further shortened, thereby further reducing the load on the power supply.

In variations of embodiments, the control unit 51 controls the first to third drive units 41 to 43 such that the rates at which the transportation velocities of the transportation members increase become higher in the transportation direction D from the downstream side toward the upstream side, i.e., the acceleration rates increase in order of the third drive unit 43 for driving the third transportation roller pair 13 located on the downstream side and then the second drive unit 42 and the first drive unit 41 for driving the second transportation roller pair 12 and the first transportation roller pair 11 located on the upstream side. Accordingly, the acceleration rate with which the first drive unit 41 drives the first transportation roller pair 11 on the upstream side that has a transportation velocity starting to increase late is higher than the acceleration rate with which the third drive unit 43 drives the third transportation roller pair 13 on the downstream side that has a transportation velocity starting to increase early, so that the differences between the times at which the accelerating operations by the first to third drive units 41 to 43 are finished can be made smaller than the differences between the times at which the accelerating operations by the first to third drive units 41 to 43 are started. Hence, all of the first to third drive units 41 to 43 can reach the transportation velocities after acceleration in a shorter time.

In variations of embodiments, the control unit 51 controls the first to third drive units 41 to 43 such that the transportation velocities of the first to third drive units 41 to 43 finish being increased at the same time (time t4) . Hence, all of the first to third drive units 41 to 43 can reach the transportation velocities after acceleration at the same time.

The present invention is not simply limited to the embodiments described herein. Components of the embodiments may be embodied in a varied manner in an implementation phase without departing from the gist of the invention. A plurality of components disclosed with reference to the described embodiments maybe combined, as appropriate, to achieve various inventions. For example, all of the components indicated with reference to embodiments may be combined as appropriate. Accordingly, various variations and applications can be provided, as a matter of course, without departing from the gist of the invention. The following indicates appendixes.

In an aspect, a transportation apparatus comprises:

a plurality of transportation members that are arranged in a transportation direction for a medium and transport the medium;

a plurality of drive units that drive the plurality of transportation members; and a control unit that controls the plurality of drive units in such a manner as to increase transportation velocities of the plurality of drive units in order from drive units for driving transportation members on a downstream side in the transportation direction to drive units for driving transportation members on an upstream side in the transportation direction.

The transportation apparatus further comprises:

a transportation path switching part that switches a transportation path between a first transportation path and a second transportation path having a greater path length than the first transportation path and joining the first transportation path, wherein the plurality of transportation members transports a medium for which the transportation path has been switched to the first transportation path by the transportation path switching part, and the control unit controls the plurality of drive units such that an equal length of time is required before a medium arrives at a joining path where the first and second transportation paths join between a case where the medium is transported to the first transportation path and a case where the medium is transported to the second transportation path.

The transportation apparatus is such that on the basis of at least either a length of the medium in the transportation direction or spacings between the plurality of transportation members, the control unit determines times to start to increase the transportation velocities of the plurality of drive units.

The transportation apparatus is such that the control unit controls the plurality of drive units such that rates at which the transportation velocities of the transportation members increase become higher in the transportation direction from the downstream side toward the upstream side.

The transportation apparatus is such that the control unit controls the plurality of drive units such that the transportation velocities of the plurality of drive units finish being increased at a same time.

The invention claimed is:

1. A transportation apparatus comprising:

a plurality of transportation members that are arranged in a transportation direction for a medium and transport the medium;

a plurality of actuators that drive the plurality of transportation members;

a processor that controls the plurality of actuators in such a manner as to increase transportation velocities of the plurality of actuators in order from actuators for driving transportation members on a downstream side in the transportation direction to actuators for driving transportation members on an upstream side in the transportation direction; and a movable guide that switches a transportation path between a first transportation path and a second transportation path having a greater path length than the first transportation path and joining the first transportation path, wherein the plurality of transportation members transports a medium for which the transportation path has been switched to the first transportation path by the movable guide, and the processor controls the plurality of actuators such that an equal length of time is required before a medium arrives at a joining path where the first and second transportation paths join between a case where the medium is transported to the first transportation path and a case where the medium is transported to the second transportation path.

2. The transportation apparatus of claim 1, wherein on the basis of at least either a length of the medium in the transportation direction or spacings between the plurality of transportation members, the processor determines times to start to increase the transportation velocities of the plurality of actuators.

3. The transportation apparatus of claim 1, wherein the processor controls the plurality of actuators such that rates at which the transportation velocities of the transportation members increase become higher in the transportation direction from the downstream side toward the upstream side.

4. The transportation apparatus of claim 3, wherein the processor controls the plurality of actuators such that the transportation velocities of the plurality of actuators finish being increased at a same time.

5. A transportation apparatus comprising:

a plurality of transportation members that are arranged in a transportation direction for a medium and transport the medium;

a plurality of actuators that drive the plurality of transportation members; and a processor that controls the plurality of actuators in such a manner as to increase transportation velocities of the plurality of actuators in order from actuators for driving transportation members on a downstream side in the transportation direction to actuators for driving transportation members on an upstream side in the transportation direction, wherein the processor controls the plurality of actuators such that rates at which the transportation velocities of the transportation members increase become higher in the transportation direction from the downstream side toward the upstream side.

* * * * *